United States Patent [19]

Minalga

[11] 3,984,745

[45] Oct. 5, 1976

[54] SEWING MACHINE STITCH PATTERN GENERATION USING SERVO CONTROLS

[75] Inventor: Philip F. Minalga, Piscataway, N.J.

[73] Assignee: The Singer Company, New York, N.Y.

[22] Filed: Jan. 8, 1974

[21] Appl. No.: 431,649

[52] U.S. Cl. ..... 318/567; 318/571; 318/676; 112/220; 112/158 E

[51] Int. Cl.[2] ..... D05B 3/02; G05B 19/10

[58] Field of Search ..... 318/567, 568, 571, 687, 318/621, 622, 676; 112/158, 220, 219; 310/13, 14

[56] References Cited

UNITED STATES PATENTS

| | | | |
|---|---|---|---|
| 3,005,136 | 10/1961 | Fluckiger | 112/158 E UX |
| 3,069,608 | 12/1962 | Forrester et al. | 318/567 X |
| 3,076,066 | 1/1963 | Caron | 112/158 E |
| 3,135,880 | 6/1964 | Olson et al. | 318/687 X |
| 3,172,025 | 3/1965 | Jones et al. | 318/687 |
| 3,172,950 | 3/1965 | Muller | 318/687 |
| 3,400,677 | 9/1968 | Bowers et al. | 112/219 A |
| 3,436,629 | 4/1969 | Adler | 318/687 |
| 3,449,754 | 6/1969 | Stutz | 318/687 X |
| 3,465,276 | 9/1969 | Silva et al. | 318/621 X |
| 3,613,608 | 10/1971 | Hinerfeld et al. | 318/568 X |
| 3,613,610 | 10/1971 | Hinerfeld et al. | 318/568 X |
| 3,724,282 | 4/1973 | Daman | 112/158 A |
| 3,735,231 | 5/1973 | Sawyer | 318/687 |
| 3,751,693 | 8/1973 | Gabor | 310/13 |
| 3,760,206 | 9/1973 | Hertrich | 310/13 |
| 3,789,285 | 1/1974 | Nishizawa | 318/687 |
| 3,789,783 | 2/1974 | Cook et al. | 112/220 |
| 3,834,332 | 9/1974 | Gude | 112/158 A |
| 3,847,100 | 11/1974 | Garron | 112/158 E |
| 3,855,956 | 12/1974 | Wurst | 112/158 E |

FOREIGN PATENTS OR APPLICATIONS

| | | | |
|---|---|---|---|
| 8675 | 3/1972 | Japan | 318/568 |
| 407319 | 5/1963 | Japan | 318/568 |
| 15713 | 6/1970 | Japan | 318/568 |

*Primary Examiner*—Robert K. Schaefer
*Assistant Examiner*—John J. Feldhaus
*Attorney, Agent, or Firm*—Edward L. Bell; Robert E. Smith; Julian Falk

[57] ABSTRACT

A system is disclosed for a sewing machine in which preselected stitch patterns may be formed automatically. Information related to the positional coordination of the needle penetration for each stitch of each pattern is stored in the sewing machine. Logic means are used to select and release said stitch information in timed relation with the operation of the sewing machine. The selected information is converted to positional analog signals which control closed-loop servo means including a moving-coil linear actuator which directly controls the position of conventional stitch-forming instrumentalities of the sewing machine to reproduce a pattern of stitches corresponding to the selected stitch information.

9 Claims, 4 Drawing Figures

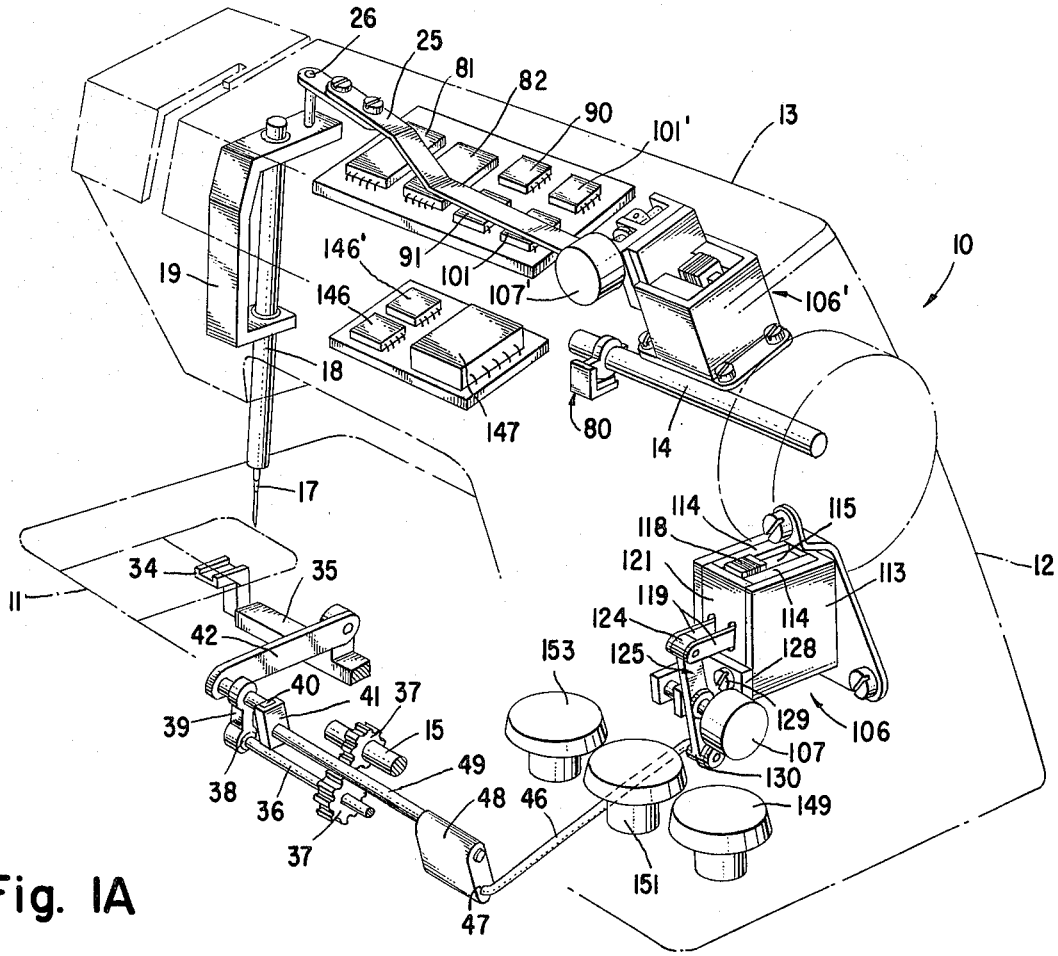
Fig. IA
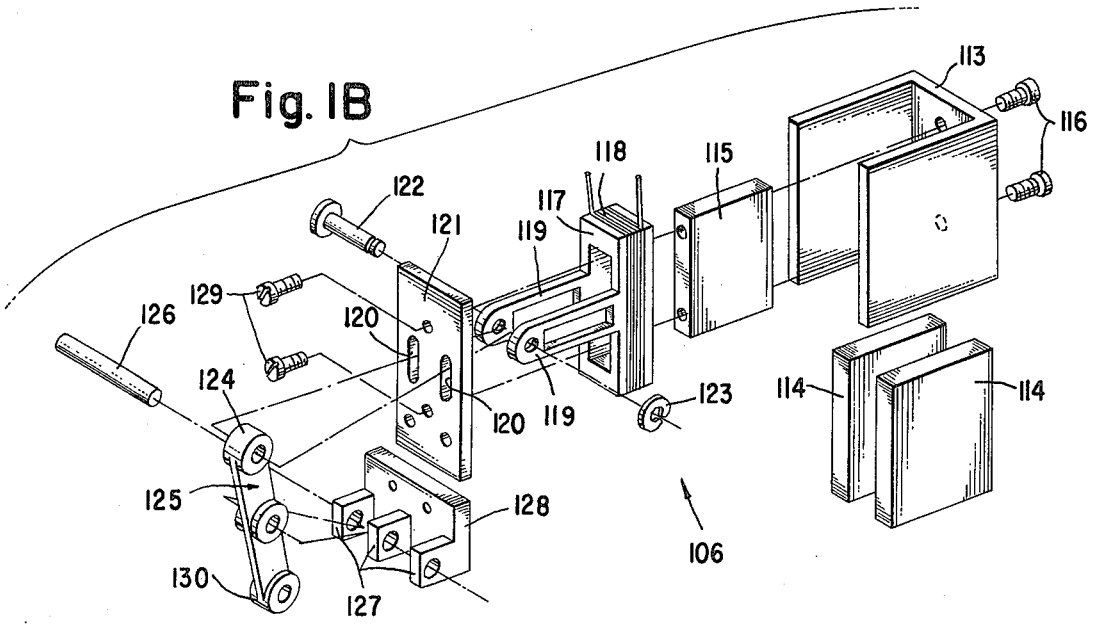
Fig. IB

SEWING MACHINE STITCH PATTERN GENERATION USING SERVO CONTROLS

BACKGROUND OF THE INVENTION

Systems are known in the prior art wherein stitch-related information stored in the sewing machine is converted to equivalent mechanical positioning movement by some form of electromechanical adder mechanism using solenoids, or by a stepping motor using a ferrous Rotor. Such prior art systems have not been completely successful because the inherently high mechanical and/or electrical inertia associated with the solenoids and/or iron rotors may result in inaccurate positioning especially at high sewing speeds. Further, these prior art systems are "open loops" systems and so do not generate corrective signals proportional to the positional error, and therefore, do not provide any attempt to correct for positional inaccuracy.

SUMMARY OF THE INVENTION

In order to overcome the shortcomings found in the prior art, the present invention comprehends in a sewing machine having means for storing information related to the positional needle coordinates for predetermined stitches of a stitch pattern and logic means for selecting and releasing said stitch information in timed relation with the operation of said sewing machine, means for converting said released information to equivalent positional analog signals, and closed-loop servo means responsive to said analog signals including a moving coil linear actuator which directly influences the conventional stitch-forming instrumentalities of the sewing machine to reproduce a pattern of stitches corresponding to the selected stitch information.

The stored stitch coordinate information must be located, read out, and converted into equivalent mechanical movement, all in the time between successive stitches. This requires a fast-response, accurate positioning system and is accomplished according to the present invention by the use of a special servo system including a moving-coil linear actuator with separate position and rate-of-change-of-position feedback loops.

DESCRIPTION OF THE DRAWINGS

The subject matter which is regarded as the invention is particularly pointed out and distinctly claimed in the concluding portion of this specification. The invention, itself, however, both as to its organization and method of operation thereof may best be understood by reference to the following descriptions taken in connection with the accompanying drawings:

FIG. 1A is a perspective view of a sewing machine including fragments of a typical driving mechanism and of a needle jogging and working feeding mechanism, and illustrating the physical elements necessary to an embodiment of this invention applied thereto;

FIG. 1B is an exploded perspective view of a preferred form of linear actuator used in an embodiment of this invention.

DESCRIPTION OF THE INVENTION

Figure 2:
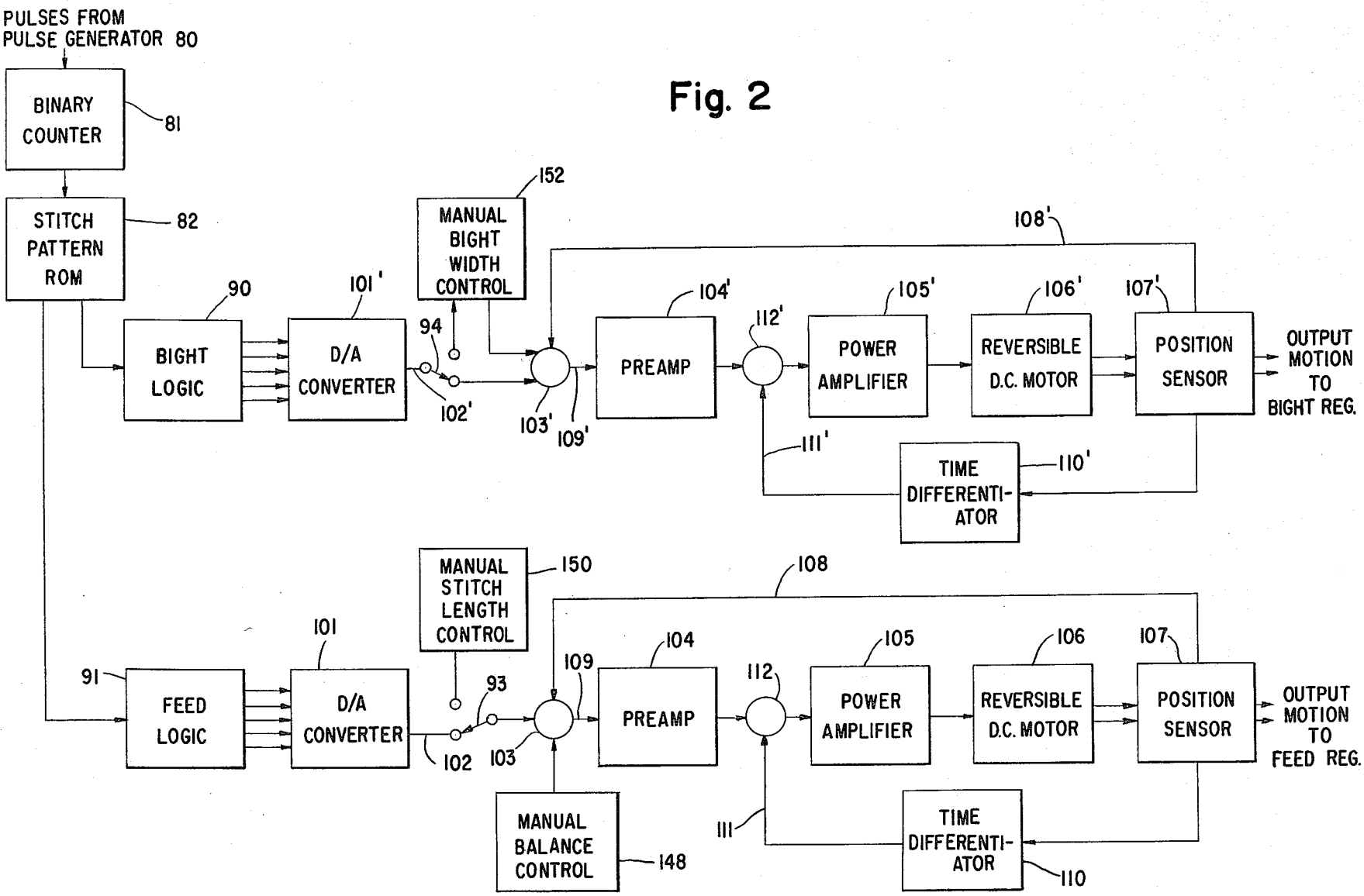
FIG. 2 is a general schematic block diagram of a system according to the present invention.

FIG. 1A of the drawings illustrates a sewing machine with fragments of two actuating mechanisms thereon, the needle bight and the work feeding mechanism, which can contribute to changes in the relative coordinates of successive needle penetration in the work.

As shown in phantom lines in FIG. 1A, a sewing machine casing 10 includes a bed 11, a standard 12 rising from the bed and a bracket arm 13 overhanging the bed. The driving mechanism of the sewing machine includes an arm shaft 14 and a bed shaft 15 interconnected in timed relation by conventional drive mechanism (not shown). A needle 17 is carried for endwise reciprocation by a needle bar 18 mounted for lateral jogging movement in a gate 19 in the bracket arm 13. Any conventional connections (not shown) may be used between the arm shaft 14 and the needle bar for imparting needle reciprocation. A drive link 25 is pivoted as at 26 to the date 19 and provides the mechanical connection to the electromechanical actuator 106' of this invention which will be described hereinbelow.

Also illustrated in FIG. 1A is a fragment of a work feeding mechanism including a feed dog 34 carried by a feed bar 35. In FIG. 1A the mechanism is illustrated for imparting work transporting movement to the feed dog including the feed drive shaft 36 driven by gears 37 from the bed shaft, a cam 38 on the feed drive shaft, and a pitman 39 embracing the cam 28 and connected to reciprocate a slide block 40 in a slotted feed regulating guideway 41. A link 42 pivotably connects the pitman 39 with the feed bar 35 so that depending upon the inclination of the guideway 41, the magnitude and direction of the feed stroke of the feed dog will be determined.

The inclination of the guideway 41 in the present invention may be controlled by an electromechanical feed actuator indicated generally at 106 which will be described hereinbelow.

The electromechanical feed actuator 106 is connected to a link 46 pivoted at 47 to a rock arm 48 which is secured on a rock shaft 49 to which the guideway 41 is affixed.

While it is possible to use any known means for storing and recovering stitch information in the system of this invention, it will be preferable to use the means shown and described in U.S. patent application Ser. No. 367,780 filed July 5, 1973, assigned to the same assignee as the present invention, which is incorporated by reference herein. For an understanding of the present invention it is sufficient to understand that the digital information output from the stitch pattern memory of the referenced system is converted, in conventional digital-to-analog converters, to equivalent analog signals used in the system of this invention as input signal to closed-loop servo systems for influencing positional movements of the conventional bight mechanism and feed regulator of the sewing machine. Thus, in the present system, the solenoid drivers, solenoids, and mechanical adders mechanisms of the referenced system are not needed, and therefore, not used.

As shown in FIG. 1A, a timing pulse generator 80 which is associated with the arm shaft 14, may be of the type shown and described in the U.S. patent application Ser. No. 364,836 filed May 29, 1973 and assigned to the same assignee as the present invention, which is incorporated herein by reference. It is sufficient for the purposes of the present invention to note that the pulse generator 80 need only produce a single well defined rectangular pulse for each rotation of the armshaft 14 and may be adjusted to begin and to terminate the pulse at discrete times in each cycle.

Referring to FIG. 2 and to the above references U.S. patent application Ser. No. 376,780, it will be seen that the pulses from the pulse generator 80 are counted up in the binary counter 81 and presented as address inputs to the stitch pattern ROM 82 which is encoded to produce as output five bits of bight or zigzag information and five bits of feed information. The bight information is processed in logic block 90 and may include a latch whereby the bight information may be held for later release to the bight servo system at a time appropriate to the operation of the needle jogging mechanism. Similarly, the feed information is processed in logic block 91 and may include a latch whereby the feed information may be held for later release to the feed servo system at a time appropriate to the operation of the feed regulator. Since the servo systems for the bight and for the feed are identical except for the specific switching necessary for manual over-ride and balance control in the feed regulating system, the following description will for convenience, be confined to the *feed* servo system only and the specific switching for each system will be described later. Corresponding blocks in each system carry the *same* reference number except that the numbers associated with the bight or needle jogging system are *primed.*

Figure 3:
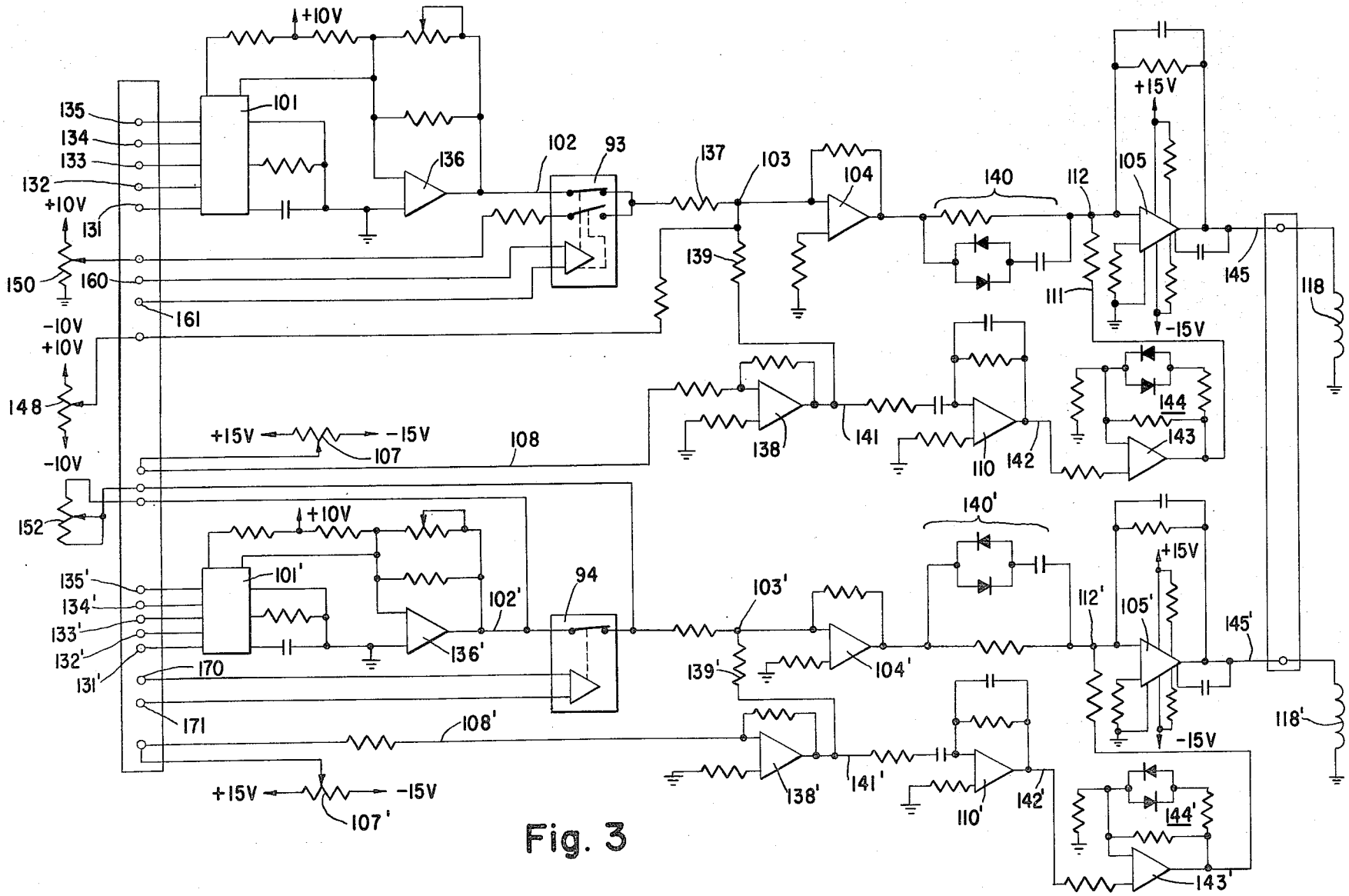
FIG. 3 is a detailed circuit diagram of the servoamplifiers and feedback loops according to this invention.

The five bits of feed information from logic block 91 are presented to a digital-to-analog converter 101, which may be a commercially obtainable Motorola MC 1406 unit. The converter 101 outputs on line 102 a d.c. analog voltage representing the required feed position input. This line connects, in the automatic mode position of a switch 93, to the summing point 103 of a low level preamplifier 104 forming the first stage of a servo-amplifier system later to be described in detail. The switch 93 may comprise an F.E.T. switch as shown in FIG. 3. The preamplifier 104 drives a power amplifier 105 which supplies direct current of reversible polarity to the electromechanical actuator 106, which in the broadest sense comprises a reversible motor, to position the actuator in accordance with the input analog voltage on line 102. A feedback position sensor 107 mechanically connected to the reversible motor 106 provides a feedback position signal on line 108 indicative of the existing output position. The input analog voltage and the feedback signal are algebraically summed at the summing point 103 to supply an error signal on line 109. The feedback signal from the position sensor is also differentiated with respect to time in a differentiator 110 and the resulting rate signal is presented on line 111 to the summing point 112 of the power amplifier 105 to modify the positional signal at that point. The position sensor 107 may be any device that generates an analog voltage proportional to position and may, in this embodiment, be a simple linear potentiometer connected to a stable reference voltage and functioning as a voltage divider. The differentiator 110 is preferably an operational amplifier connected to produce an output signal equal to the time rate of change of the input voltage as is well known in this art.

While the reversible motor 106 may be a conventional low-inertia rotory d.c. motor, it is preferable, for the purposes of the present invention that it take the form of a linear actuator in which a lightweight coil moves linearly in a constant flux field and is directly coupled to the load to be positioned. This simplifies the driving mechanical linkage and minimizes the load inertia of the system.

While any known form of linear actuator may be used in the present invention, a brief description of a preferred form will now be given with reference to FIGS. 1A and 1B. Since both linear actuators 106 and 106' are identical, the following description will be confined to the actuator 106 for regulating the feed.

A U-shaped magnetically permeable yoke 113 is secured to the sewing machine frame by any suitable means. Secured to each of the two inner faces of the yoke is a permanent magnet 114. These magnets are magnetized across the small dimension so as to present the same polarity to the opposed inner faces thereof. A single center leg 115 of magnetically permeable material, positioned centrally between the magnets as by fastening screws 116, provides both a flux return path and a guide on which is slidably mounted a bobbin 117 carrying a winding 118. The bobbin is made of lightweight insulating molded plastic and is formed with lugs 119 which project externally through slot 120 in a magnetically permeable cover plate 121. The center leg 115 is secured between the cover plate 121 and the bottom of the yoke 113.

The lugs 119 are pivotally connected as by a headed pivot pin 122 fitted with a spring clip retainer 123 to one end 124 of a lever 125 having a pivot shaft 126 secured thereto and journaled in lugs 127 of a pivot plate 128 secured to the cover plate 121 as by screws 129. The rotary potentiometer 107 has a body portion secured relatively to a fixed element of the sewing machine frame or of the actuator 106 and, for instance, may be secured to the pivot plate 128. The rotatable or shaft portion (not shown) of the potentiometer 107 is secured for rotation with the pivot shaft 126. The other end 130 of the lever 125 is pivotably connected to the link 46 which operates the feed regulator shaft 49. It will be apparent from the above description that the gap flus of the linear force applied to the wound bobbin 117 is proportional only to the current in the winding 118 which in turn is proportional only to the voltage applied to the winding 118 from the power amplifier 105. It is also evident that this force may be reversed in direction by reversing the voltage polarity.

As will be described in detail below, the potentiometer 107 is used as a linear voltage divider for a regulated reference voltage. By using a conventional double-ended power supply for the reference voltage, the potentiometer can be made to provide a discrete voltage output of either polarity corresponding to each output position of the lever 125. Zero voltage may be made to occur at any convenient position.

Since the voltage produced by the potentiometer 107 is by servo action always fed back to the flux in a linear actuator is essentially constant so that the linear force reduce the positional error to zero, the linear actuator 106 will mechanically drive the feed regulator shaft 49 to a position where the potentiometer voltage just equals the voltage output from the digital-to-analog converter 101 and representing the desired position. At this point, the error voltage approaches zero and the system is in equilibrium, with the load at rest in the desired position.

From the above it is evident that the voltage versus position characteristic of the potentiometer 107 establishes the desired positional input voltage to the servo corresponding to the desired load position. While it is desirable that this characteristic be linear it is not a critical requirement. It is, of course, preferable that the reference voltage be stable and this may be obtained from any well regulated supply known to the art.

While any suitable servo control circuit may be used in the present invention, a brief description of a preferred circuit will now be given with reference to FIG. 3. Since both bight and feed servo control circuits are essentially the same, the following description will be confined to the feed regulating circuit. Corresponding elements in each system carry the *same* reference number except that the numbers associated with the bight or needle jogging system are *primed.*

The five bits of feed information presented on lnes 131 to 135 are converted in the digital-to-analog converter 101 to a single analog voltage which is passed through a buffer amplifier 136 and through switch 93 of which the function will be described later and summing resistor 137 to summing point 103 of a preamplifier 104. The output voltage on line 108 from the feedback potentiometer 107 is passed through a buffer amplifier 138 and through summing resistor 139 to a summing point 103 where the analog feed position voltage indicative of desired position is algebraically summed with the feedback voltage indicative of existing position. The ressult is an error voltage indicative of the magnitude and sense of the disagreement between the desired and existing output position of the linear actuator. It is this error voltage which is further amplified and modified to drive the linear actuator to a final position in which the existing position equals the desired position and the error voltage approaches zero.

The error voltage output from the preamplifier 104 is passed through a non linear error-rate network 140 and presented to summing point 112 of a power amplifier 105. The buffered feedback voltage on line 141 is presented to the operational amplifier 110 connected as a conventional differentiator which produces on line 142 a rate voltage equal to the time rate of change of the feedback voltage. This rate voltage is amplified in a nonlinear gain controlled amplifier 143 and presented on lne 111 to the summing point 112 of the power amplifier 105. It is this rate feedback loop with non linear gain control provided by feedback loop 144 and terminating at summing point 112 which provides the damping necessary to bring the linear actuator 106 quickly to rest in the desired position. The voltage output on line 145 is presented to winding 118 of linear actuator 106.

It will be understood that all of the individual amplifiers comprising the servocontrol circuit described above may be conventional integrated circuit operational amplifiers having feedback loops providing gain characteristics as desired in accordance with well-known principles. These amplifiers may be grouped together into one integrated block 146 as shown in FIG. 1A. Further it is understood that a double-ended regulated power supply of conventional form may be used to power the amplifiers and furnish reference voltages for the manual over-ride and balance control to be described presently. Such a power supply, preferably having bi-polar terminals supplying the necessary D.C. voltage and connected to the regular A.C. house mains may conveniently be made in one integrated block 147 as shown in FIG. 1A.

In the system of the present invention wherein a specific analog voltage represents a specific output position, it is a relatively simple matter to modify or to completely over-ride the analog voltage provided by the information from the pattern memory by modifying, adding thereto, or substituting in place of the analog voltage a manually controlled voltage of magnitude and polarity necessary to produce the desired position as will now be described.

The output motion of the conventional feed dog is accurately controlled in direction and amount by the feed regulator shaft 49 but the actual amount of feed imparted to the work itself does not necessarily follow in a one-to-one relation therewith and depends on many factors including the nature and thickness of the work, the pressure applied by the presser-foot and the rate of feed. To compensate for such discrepancy, it is proposed, according to this invention, to introduce at summing point 103 (see FIG. 2) a balance control voltage derived, as shown in FIG. 3, from a potentiometer 148 connected as a voltage divider to the double ended reference voltage output of the power supply 147. A knob 149, shown in FIG. 1A, may be located on the sewing machine for convenient adjustment of the potentiometer 148 by the cperator to effect a visually observable fine control of the actual material feed.

The switch 93 shown in the automatic mode position in FIG. 2 may be operated to the other or manual position by the application of the proper control voltage to lines 160; 161. This disconnects the analog position voltage on line 102 from the summing point 103 and substitutes therefor a voltage obtained from a potentiometer 150 shown in FIG. 3 and connected as a voltage divider between the double ended reference voltage terminals of the power supply 147. A knob 151, shown in FIG. 1A, may be located on the sewing machine for convenient manipulation by the operation in manually setting the stitch length.

Reverting now to the bight control channel of FIG. 2, a switch 94 shown in the automatic mode position may be operated to the other or manual position by application of the proper control voltages to the lines 170 and 171. The switch 94 may comprise an F.E.T. switch as shown in FIG. 3. This operation *inserts* a potentiometer 152, as shown in FIG. 3, which acts as a scaling rheostat for the analog bight voltage on line 102' to provide any desired fraction of this voltage at the summing point 103' and so provides convenient means for narrowing the pattern. A knob 153, shown in FIG. 1A, may be located on the sewing machine for convenient manipulation of the potentiometer 152 by the operator for lateral control of the bight width.

The important and basic rationale of the system of this invention is (1) a program controller in a sewing machine for storing and delivering pattern information related to the required position of the bight mechanism and feed regulator thereof to produce a desired stitch pattern, (2) the conversion of this pattern information into analog voltages representing the required position of the bight mechanism and feed regulator, (3) position sensors for providing position voltages related to the existing position of the bight mechanism and feed regulator, (4) means for comparing said analog voltages with said existing position voltages and for delivering error voltages reflecting the magnitude and sense of the difference therebetween, (5) reversible electric motor means for positioning said bight mechanism and feed regulator, and (6) servo means including position and rate feedback loops for energizing said reversible motor means in an amount and direction to reduce the positional error.

Having set forth the nature of the invention, what is claimed herein:

1. In a sewing machine having a casing, including a bed, a standard rising from said bed, and a bracket arm extending from said standard and overhanging said bed, stitch forming instrumentalities carried in said casing, actuating mechanism in said casing connected with said stitch forming instrumentalities to impart stitch forming movements thereto, driving means operatively associated with said actuating mechanism, and analog mechanism in said casing for influencing in a continuous manner the stitch position coordinates of said stitch forming instrumentalities to produce successive stitches in an ornamental pattern, a reversible electric motor in said casing separate from said driving means and electrically driven in either direction, said reversible electric motor being operatively connected directly to said analog mechanism for influencing said stitch position coordinates for controlling the ornamental pattern of stitches produced thereby, a program controller in said casing delivering pattern signals related to the required position of said stitch forming instrumentalities to produce the ornamental pattern, a position sensing device in said casing driven by said electric motor for delivering position signals related to the existing position of said stitch forming instrumentalities, means in said casing for comparing said pattern and position signals and for delivering an error signal reflecting the magnitude and sense of a positional error between the existing and required positions of said stitch forming instrumentalities, and means in said casing for converting A.C. power into regulated D.C. power and for directing current from said regulated D.C. power in accordance with said error signal to said reversible electric motor in an amount and a direction to reduce said positional error.

2. In a sewing machine as set forth in claim 1, in which the output motion of said reversible electric motor is controlled by separate position and rate feedback loops.

3. In a sewing machine having stitch forming instrumentalities including an endwise reciprocable thread carrying needle, a work advancing feed mechanism, mechanism for imparting endwise reciprocable movements to said needle to influence stitch forming cycles each cycle including a portion in which said needle penetrates the work to concatenate the sewing threads and a portion in which the needle is withdrawn from the work in which the said feed mechanism advances the work, and analog means for positionally controlling said stitch forming instrumentalities continuously over a predetermined range between stitches to produce a pattern of stitches, comprising static means for storing information in digital form in said sewing machine related to the position of each stitch of the pattern, logic means for selecting and releasing said information, digital-to-analog converter means for generating positional analog signals related to said selected digital information, means for delivering analog position signals related to the existing position of said stitch forming instrumentalities, means utilizing said released information and said position signals to generate analog error signals of variable magnitude and direction, actuator means responsive to said error signals, for positionally controlling said stitch forming instrumentalities to reproduce the selected patterns of stitches, means effective within that portion of each stitch forming cycle in which the needle is withdrawn from the work for initiating selection and release of said information by said logic means and obtaining a response of said actuator means to said error signals, and means for maintaining said error signal obtained response of said actuator means during the succeeding needle penetration.

4. In a sewing machine according to claim 3 in which the information storage means is a static memory containing stitch information stored in digital form.

5. In a sewing machine according to claim 3 in which response of said actuator means within that portion of each stitch forming cycle in which the needle is withdrawn from the work is obtained by an arrangement in which actuator means comprises a linear motor of which the only moving element is a coil of wire wound on a non-metallic bobbin, and in which the output motion of the linear motor is controlled by separate position and rate feedback loops of which the rate feedback loop is entirely static and includes a static rate generator comprising an operational amplifier connected to produce an output signal proportional to the time rate of change of the input voltage thereto.

6. In a sewing machine having both bight and feed related stitch-forming instrumentalities, both associated with means for effecting positional control over a predetermined range between stitches to produce a pattern of stitches, static means for storing bight and feed pattern stitch information related to each stitch of the pattern in digital form, means operating in timed relation with the sewing machine for recovering selected pattern stitch information from said storage means, digital-to-analog converter means for generating positional analog signals related to said selected digital information, and closed loop servo means including separate moving-coil actuators directly coupled one to each of said means for effecting positional control of said stitch forming instrumentalities and each responsive to said analog signals for positioning said means for effecting positional control of said stitch forming instrumentalities in time relation between each stitch formation to produce a pattern of stitches corresponding to the selected pattern stitch information.

7. In a sewing machine according to claim 6, in which manually-controlled electrical means is used to compensate for work-related differences between the actual feed and the feed represented by the analog signal derived from the stored information.

8. In a sewing machine according to claim 6, in which a manually controlled voltage is substituted for the analog signal derived from the stored information to enable manual control of stitch length.

9. In a sewing machine according to claim 6, in which a manually controlled voltage divider is inserted in circuit to enable selection of any desired fraction of the analog signal derived from the stored information for manual control of bight width.

* * * * *

UNITED STATES PATENT OFFICE

CERTIFICATE OF CORRECTION

PATENT NO. : 3,984,745

DATED : October 5, 1976

INVENTOR(S) : Philip F. Minalga

It is certified that error appears in the above-identified patent and that said Letters Patent are hereby corrected as shown below:

Column 2, line 20 "date" should read -- gate --

Column 2, line 29 "28" should read -- 38 --

Column 4, line 40 "flus" should read -- flux --

Column 4, line 40 after "linear" insert -- actuator is essentially constant so that the linear --

Column 4, line 55 after "the" delete -- flux in a linear -- and insert -- input in a sense to --

Column 4, line 56 delete -- actuator is essentially constant so that the linear force --

Column 5, line 14 "lnes should be -- lines --

Column 5, line 26 "ressult" should be -- result --

Column 5, line 42 "lne" should be -- line --

Signed and Sealed this

Eighth Day of March 1977

[SEAL]

*Attest:*

RUTH C. MASON
*Attesting Officer*

C. MARSHALL DANN
*Commissioner of Patents and Trademarks*